US012766396B2

(12) United States Patent
Gao

(10) Patent No.: US 12,766,396 B2
(45) Date of Patent: Oct. 20, 2026

(54) INSTANT MULTIFUNCTIONAL GOLF PRACTICING TENT

(71) Applicant: Xinwei Gao, North York (CA)

(72) Inventor: Xinwei Gao, North York (CA)

( * ) Notice: Subject to any disclaimer, the term of this patent is extended or adjusted under 35 U.S.C. 154(b) by 861 days.

(21) Appl. No.: 17/467,932

(22) Filed: Sep. 7, 2021

(65) Prior Publication Data

US 2022/0409976 A1 Dec. 29, 2022

Related U.S. Application Data

(60) Provisional application No. 63/216,253, filed on Jun. 29, 2021.

(51) Int. Cl.

| | |
|---|---|
| ***A63B 69/36*** | (2006.01) |
| ***A63B 71/02*** | (2006.01) |
| ***A63B 71/06*** | (2006.01) |
| ***E04H 15/02*** | (2006.01) |
| ***E04H 15/48*** | (2006.01) |

(52) U.S. Cl.

CPC ..... *A63B 69/3623* (2013.01); *A63B 71/022* (2013.01); *A63B 71/0622* (2013.01); *E04H 15/02* (2013.01); *E04H 15/48* (2013.01); *A63B 2071/0691* (2013.01); *A63B 2210/50* (2013.01); *A63B 2214/00* (2020.08); *A63B 2220/05* (2013.01)

(58) Field of Classification Search

CPC . A63B 69/3623; A63B 69/36; A63B 69/3617; A63B 69/3694; A63B 71/022; A63B 2071/0691

USPC ..... 473/150, 154, 164, 172, 173, 190, 197

See application file for complete search history.

(56) References Cited

U.S. PATENT DOCUMENTS

| | | | | |
|---|---|---|---|---|
| 4,556,219 | A * | 12/1985 | Tillery | A63B 63/00 473/197 |
| 5,020,802 | A * | 6/1991 | af Strom | A63B 69/3623 473/165 |
| 5,088,740 | A * | 2/1992 | Peterson | A63B 63/00 473/421 |
| 8,069,872 | B2 * | 12/2011 | Bae | E04H 15/48 135/147 |
| 8,164,830 | B2 * | 4/2012 | Astill | A63B 71/0619 359/461 |
| 8,894,511 | B2 * | 11/2014 | Lore | A63B 69/3623 273/400 |
| 10,982,465 | B2 * | 4/2021 | Jin | E04H 15/48 |

(Continued)

*Primary Examiner* — Joseph B Baldori

(57) ABSTRACT

A method and system for an instant multifunctional tent having a tent for accepting golf balls that are launched into the tent, a collapsible frame structure for providing structural support for the instant tent, one or more receiving net(s) coupled to the tent ceiling, and extending loosely towards the floor, and a quick set-up and take-down (instant) hub for quickly launching the tent from the folded position into a fully built or expanded position and for quickly collapsing the fully built or expanded instant tent into the fully folded position so that the instant tent may be easily stored and transported. The receiving nets increase golf practicing safety by ensuring the golf ball never penetrating the back panel and causing damages. Additional receiving nets not only further ensure that but also add advanced features like tracking and simulating the trajectory of the golf ball if shot on a real golf court.

15 Claims, 9 Drawing Sheets

(56) References Cited

U.S. PATENT DOCUMENTS

| | | | | |
|---|---|---|---|---|
| 2006/0016467 | A1* | 1/2006 | Bae | E04H 15/48 135/98 |
| 2006/0289048 | A1* | 12/2006 | Choi | E04H 15/48 135/156 |
| 2007/0151588 | A1* | 7/2007 | Yul | E04H 15/50 135/135 |
| 2012/0270670 | A1* | 10/2012 | Kunkle | A63B 69/3623 473/173 |
| 2013/0116061 | A1* | 5/2013 | Zhao | A63B 71/04 473/221 |
| 2014/0171225 | A1* | 6/2014 | Paulson | A63B 63/00 473/421 |
| 2015/0129008 | A1* | 5/2015 | Li | E04H 15/32 135/147 |
| 2015/0191931 | A1* | 7/2015 | Li | E04H 15/42 135/147 |
| 2015/0352421 | A1* | 12/2015 | Candello | A63B 63/003 473/456 |
| 2016/0289998 | A1* | 10/2016 | Huang | E04H 15/48 |
| 2017/0189773 | A1* | 7/2017 | Cho | A63B 63/00 |
| 2019/0234101 | A1* | 8/2019 | Lu | E04H 15/18 |
| 2019/0234102 | A1* | 8/2019 | Lu | E04H 15/50 |
| 2022/0105413 | A1* | 4/2022 | Shi | E04H 15/405 |
| 2023/0076144 | A1* | 3/2023 | Gao | A63B 71/022 |

* cited by examiner

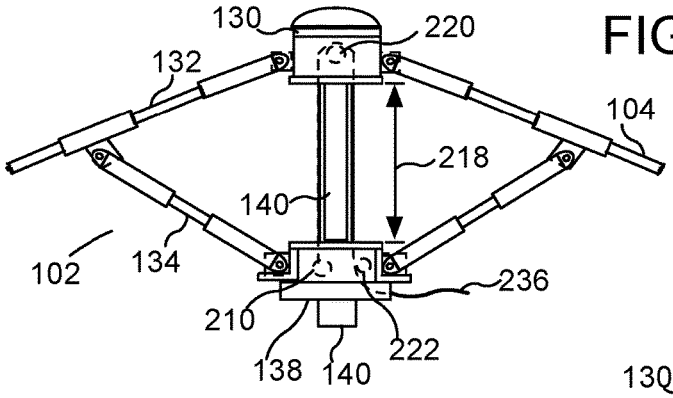
FIG. 2A
FIG. 2B
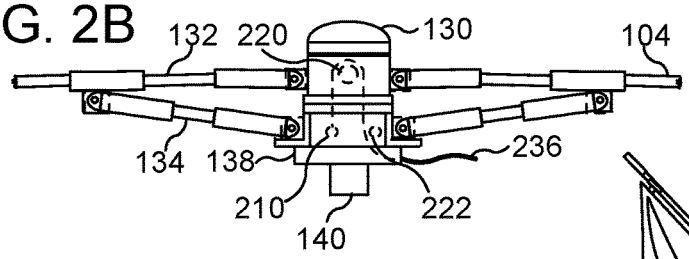
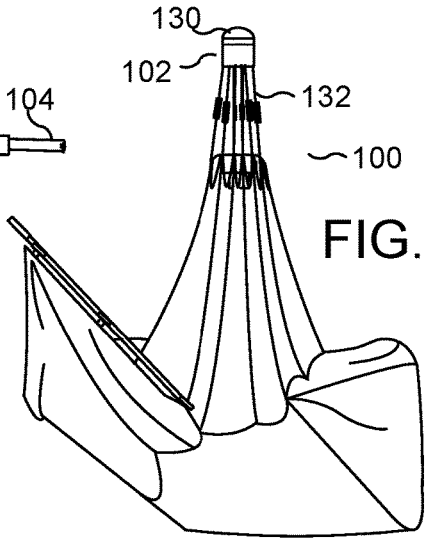
FIG. 2C
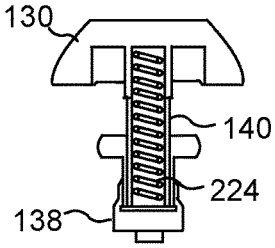
FIG. 2D
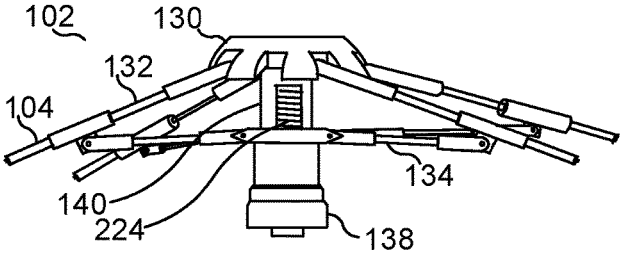
FIG. 2E
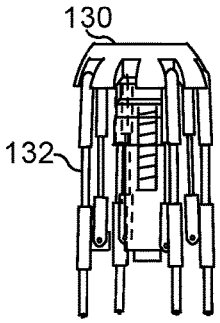
FIG. 2F

INSTANT MULTIFUNCTIONAL GOLF PRACTICING TENT

CROSS-REFERENCE TO RELATED APPLICATION

This application claims the benefit of U.S. Provisional Patent Application No. 63/216,253, filed Jun. 29, 2021. The entire disclosure of the above application is incorporated herein by reference.

FIELD

The present disclosure relates to the field of portable mechanical products in sports and especially to the methods and systems that aid training for golf skills at locations where an actual golf court or facility is not available.

BACKGROUND

Golf is well known and enjoyed by multitudes of people around the world. It's very easy to practice chipping, pitching, and all the short shots without having access to a driving range. However, finding the space to master your long shots makes things a little more complicated. There is a way around this problem by using a golf hitting net or practicing tent. Using a net/tent enables practicing long shots using irons and woods without the risk of damaging any surroundings. These advantages make the golf hitting net an ideal way to improve the golf game. For these golf practicing nets/tents to be more portable, many such nets or tents are supported by a retractable and collapsible metal frame. Additionally, it is well known in the golf industry to practice golf by hitting a golf ball directly into a golf practice tent. Such tents use panels that are generally comprised of a taut mesh or net. Although one may practice using a mesh, it lacks means of ascertaining if the ball will reach the intended hole in actual practice, i.e., it lacks means of measuring the accuracy of the hit ball.

One problem associated with retractable/collapsible practice nets is that it takes some muscular strength to unfold them for commissioning and folding them for packing. Suppose one wants to erect the collapsible practice net quickly. In that case, another problem is one must be skilled in assembling different parts into an assembled practice net without assistance from instruction manuals. Even if the instruction manual is well written, it takes time to assemble numerous parts into an erect practice net. If the instruction manual is not well written, it results in frustration and a longer assembly/disassembly period for users. Retractable/collapsible nets are generally tricky to fold properly. It's a lot like folding a map. There are many ways to fold a map, but only one way gets all the creases to line up properly and look decent instead of a big mess. The multiplicity of parts and the skill required in assembly/disassembly is an irritant for many golf enthusiasts who want to practice.

Another less appreciated matter among collapsible-practice-net users is the hazard associated with using these structures. According to a study, assembly/disassembly (i.e., general injury while assembling or disassembling) and strain injuries (i.e., a strain injury resulting from the rigorous nature of tent handling) are among the top eighteen hazard patterns associated with tents. It is well known that golf ball injuries can be severe. Golf balls are small, heavy, and falling from great heights can increase the potential severity of any injury caused.

The third undesirable aspect of the existing practicing nets is their single functionality. If you want to take a camping trip and play golf along with your vocation, you might not bother to carry two pieces of equipment—a camping tent and a golf practicing net in your luggage. Why cannot they be combined into one simple gold practicing tent?

The existing collapsible practice nets usually have a single net to stop the golf ball. It is not unusual for the existing collapsible practice nets to rupture due to the ball's impact resulting in property damage and minor to fatal injuries. Thus, there is an unmet need to improve existing collapsible practice nets to prevent property damage, injuries, and lost lives.

With the advent of golf simulators, golf enthusiasts have an option to choose from simulator mats or projector-based, sonic-sound-based, radar-based, optical-sensor-based, and camera-based systems. However, cost, outdoor use functionality, portability, and need for tech-savviness are some of the many challenges associated with these golf simulators.

As a result, there exists a need for improvements over the prior art and, more particularly for a golf practice net that provides a golf enthusiast with an accurate, reliable, flexible, and user-friendly method and system to use a real golf ball in an indoor/outdoor setting of choice, provides ease in unfolding/folding, is equipped with providing desirable features, and reduces the likelihood and severity of injury to the golf enthusiast and of damage to the golf practice net in a cost-effective manner.

SUMMARY

The present disclosure presents a method and system for a quick set-up and take-down, aka instant tent, doubled as a multifunctional golf practicing net. In one embodiment, the instant multifunctional golf practicing tent comprises a ceiling, a floor, two opposing side panels, a back panel, and an open face and one or more receiving nets for accepting golf balls that are launched into the tent; a collapsible frame structure at least partially external to the ceiling, two opposing side panels, back panel and floor panel providing structural support and enclosure for the instant tent; an upper end of a receiving net coupled to the ceiling, side panels or frame structure towards the ceiling and a lower end of the receiving net extending loosely towards the floor; the receiving net spaced apart from the back panel and/or the open face; and a quick set-up and take-down (aka instant) hub as a part of the collapsible frame structure for quickly launching the instant tent from the folded position into a fully built or expanded position and for quickly collapsing the fully built or expanded instant tent into the fully folded position so that the instant tent may be easily stored and transported.

The instant hub enables quick launching and collapsing of the instant tent with minimal effort. Non-limiting examples of minimal effort include manually operating a string or ring-shaped runner for both opening and/or closing; or pushing a button for a spring-loaded or pneumatically operated mechanism to create a force for quickly launching and collapsing the instant tent. Minimal effort is defined as much less muscular strength, operating steps, attention, and skill required than manually assembling and collapsing a collapsible practice net. For example, a person with half or one-third of the physical strength required for manually assembling and collapsing can do the same task. Thus, the present invention enables a golf enthusiast to forgo instruction manual (less operating steps and attention) and lessens the need for physical strength.

The receiving net attenuates the ball's kinetic energy in the form of speed and changes its moving direction to contain it within the instant tent to prevent property damage and physical injuries. Adding receiving net can increase golf practicing safety by ensuring the golf ball will never penetrate the back panel and causing damages. Applying additional receiving nets not only further ensure safety but also add advanced functions. In some embodiments, the receiving net is also a measuring net used to identify, infer, and monitor the golf ball's trajectory. This is especially true when multiple such receiving/measuring nets are installed in the instant tent. When the ball hits the measuring receiving net, the ball's hitting location can be identified by measuring maps. The net's lower end swings toward the back of the tent due to the striking force and/or trajectory of the ball. The ball then comes to rest at a location on the floor panel depending on the ball's speed, angle, and/or trajectory. The floor panel is pre-marked to show the corresponding actual distance the ball might have traveled if it was shot on an actual golf court. In other embodiments, a trajectory monitoring device, for example, a camera, is used to monitor and/or record the trajectory of the ball hitting the receiving net, and an instant prediction software analyzes the recording and translates that trajectory into a simulated trajectory of that ball if shot on an actual golf court. This simulation provides a near-real feeling, effect, and value of practicing on the actual golf court. In yet other embodiments, the receiving net has an image of a target or golf holes on the actual golf court.

The instant golf practicing tent in the present disclosure can be used to practice both swing, sand, and green golf skills, also multi-functionally used as a camping tent, beach tent, and/or other vocational shelters. The instant golf practicing tent can also have one or more side extension panels acting as a barrier to catch balls that miss the tent. The instant tent also has extension feet that allow adjustment to the length of the tent's extension poles as needed.

Thus, the instant tent overcomes the prior art limitations and provides an accurate, flexible, reliable, and user-friendly method and system for quickly launching and collapsing a practice net with minimal effort giving the golf enthusiast a near-real feel of practicing the actual golf court.

BRIEF DESCRIPTION OF THE DRAWINGS

The accompanying drawings, which are included to further understand the invention and are incorporated in and constitute a part of this application, illustrate embodiment (s) of the present disclosure and, together with the description, serve to explain the principle of the invention. For simplicity and clarity, the figures of the present disclosure illustrate a general manner of construction of various embodiments. Descriptions and details of well-known features and techniques may be omitted to avoid unnecessarily obscuring the discussion of the present disclosure's described embodiments. It should be understood that the elements of the figures are not necessarily drawn to scale. The term FIG. intends to include Figure & figure, and FIGs intends to include Figures & figures. Some elements' dimensions may be exaggerated relative to other elements for enhancing the understanding of described embodiments. In the drawings:

FIG. 2A is a partial side view of an embodiment of instant hub with a pulley and string mechanism in its semi-folded position.

FIG. 2B is a partial side view of the instant hub in FIG. 2A in its fully expanded position.

FIG. 2C is a perspective view of an instant tent in a semi-folded form.

FIG. 2D is a partial view of another embodiment of instant hub with a spring mechanism.

FIG. 2E is a side view of the instant hub in FIG. 2D in its semi-folded position.

FIG. 2F is a side view of the instant hub in FIG. 2E in its fully folded position.

DETAILED DESCRIPTION

Figure 1A:
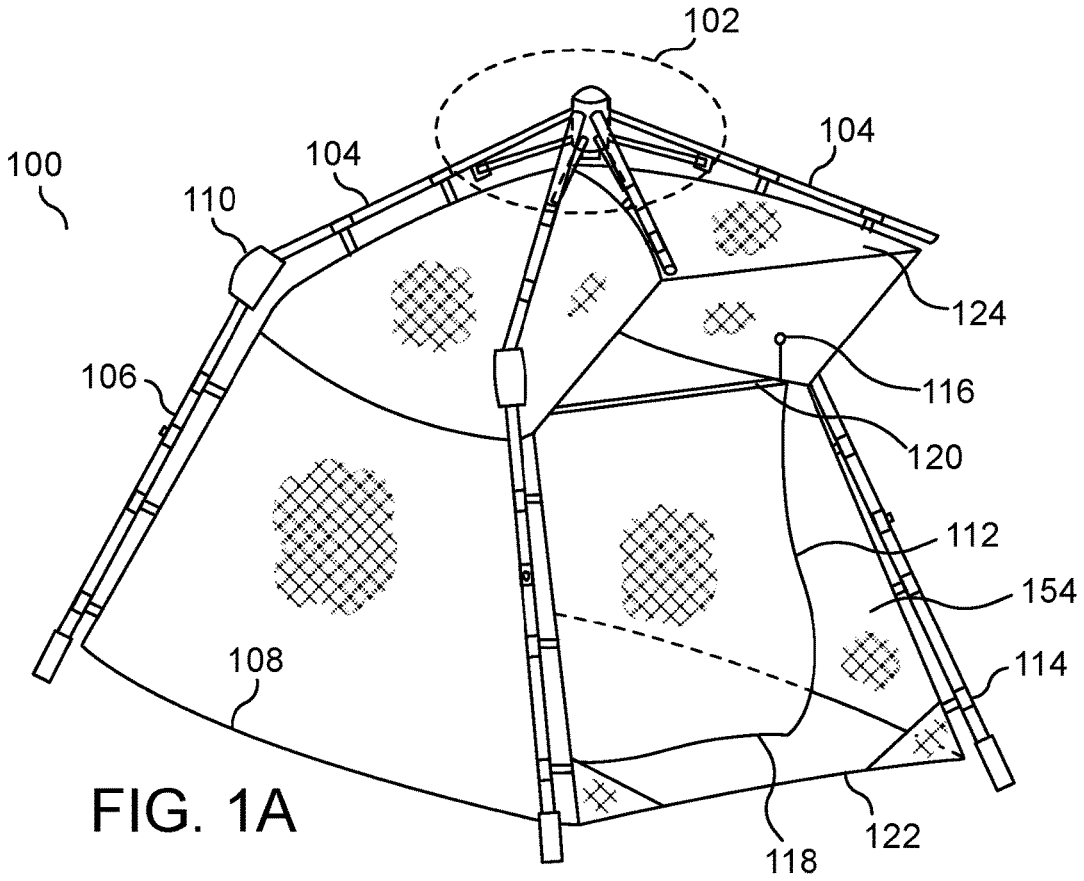
FIG. 1A is a perspective view of a preferred embodiment of an instant golf practice tent of the present disclosure.

The present disclosure generally relates to instant multi-functional tent systems and methods that may take various forms and double as a golf practicing net. Various examples of the present invention are shown in the drawings. However, the present invention is not limited to the illustrated embodiments. In the following description, specific details are mentioned to give a complete understanding of the present disclosure. However, it may likely be evident to a person of ordinary skill in the art; hence, the present disclosure may be applied without mentioning these specific details. The present disclosure is represented as few embodiments; however, the disclosure is not necessarily limited to the particular embodiments illustrated by the figures or description below.

The language employed herein only describes particular embodiments; however, it is not limited to the disclosure's specific embodiments. The terms "they", "he/she", "his or her", or "he or she" are used interchangeably because "they," "them," or "their" are considered singular gender-neutral pronouns. The terms "comprise" and/or "comprising" in this specification are intended to specify the presence of stated features, steps, operations, elements, and/or components; however, they do not exclude the presence or addition of other features, steps, operations, elements, components, or groups.

Unless otherwise defined, all terminology used herein, including technical and scientific terms, have the same definition as what is commonly understood by a person of ordinary skill in the art, typically to whom this disclosure belongs. It will be further understood that terms, such as those defined in commonly used dictionaries, should be interpreted as having the same meaning as defined in the context of the relevant art and the present disclosure. Such terms should not be construed in an overly strict sense unless explicitly described herein. It should be understood that multiple techniques and steps are disclosed in the description, each with its individual benefit. Each technique or step can also be utilized in conjunction with a single, multiple, or all of the other disclosed techniques or steps. For brevity, the description will avoid repeating each possible combination of the steps unnecessarily. Nonetheless, it should be understood that such combinations are within the scope of the disclosure. Reference will now be made in detail to some embodiments of the present invention, illustrated in the accompanying figures. The followings are some of the element numbers used in these figures.

100 Instant golf practice tent
102 Instant hub
104 base pole
106 Telescopic pole
108 Side panel
110 Joint member
112 First receiving net
114 Canopy fastener
116 Receiving fastener
118 Lower end
120 Upper end
122 Tent floor
124 Roof panel
130 Base cap
132 Hub pole
134 Moving pole
138 Locking member
140 Cylinder
144 Back panel
154 Open face
210 Fixed end
218 Collapsing/Opening (CO) distance
220 Fixed pulley
222 Movable pulley
224 Spring
236 Cable
304 Stopping pocket
306 Joint member
312 Extension pole
314 Push-button
322 Telescopic direction
402 Receiving pole
404 Joint member
406 First distance
408 Second distance
412 Second receiving net
502 Third receiving net
504 Map
506 Third distance
510, 512 Map regions
602 Golf ball
604 Tracking device
606 Stand
608 Trajectory
612 First panel
614 First curtain
616 Second panel
618 Third panel
620 Second curtain
622 Third curtain
624 Hole
702 Target hole
802 Extension panel
906 Extension feet
908 Hole
910 Pin As noted above, FIG. 1A is a perspective view of a preferred embodiment of an instant golf practice tent (100) consists of a ceiling (124), a floor panel (122), two opposing side panels (108), a back panel (144) (shown in FIG. 3A), and an open face (154) opposing the back panel (144) for accepting golf balls that are launched into the instant golf practice tent (100). The terms instant golf practice tent, quick set-up, and take-down tent, and instant tent are used interchangeably in this disclosure. The instant golf practice tent (100) also has a collapsible frame structure that is at least partially external to the ceiling (124), two opposing side panels (108), a back panel (144) (not shown), and a floor panel (122). The collapsible frame structure provides structural support to the instant golf practice tent (100) and consists of an instant hub (102) connected to the base poles (104). One or more base poles (104) are further connected to telescopic poles (106) via joint members (110). In some embodiments, the joint members (110) enable the base poles (104) and telescopic poles (106) to be pivoted about the joint member (110) in a folding manner. The instant tent has a first receiving net (112) for accepting golf balls launched into the instant golf practice tent (100). The first receiving net (112) extends vertically between and is spaced apart from the back panel (144) and the open face (154).

Receiving fasteners (116) fasten an upper end (120) of the first receiving net (112) to the ceiling (124), side panels (108), and/or collapsible frame structure towards the ceiling (124). The receiving fasteners (116) include rope, string, chain, button, snap-fit, etc. In some embodiments of the instant golf practice tent (100), an upper portion of the first receiving net (112) may be fastened with the side panels (108) and/or collapsible frame structure. Receiving fasteners (116) discussed in this disclosure may be fastened, unless stated otherwise, to the ceiling (124), side panels (108), and/or collapsible frame structure towards the ceiling (124). Although the upper end (120) and/or upper portion of the first receiving net (112) is fastened, a lower end (118) of the receiving net (112) extends loosely towards the floor (122). In other words, the lower end (118) of the first receiving net is not connected to any other part of the instant golf practice tent (100).

Figure 1B:
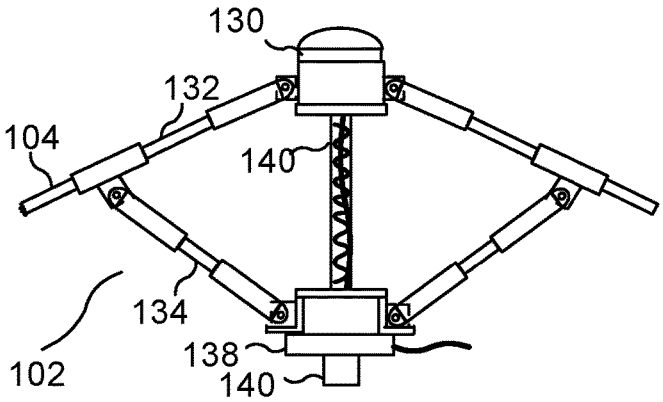
FIG. 1B is a partial view of the instant hub shown in FIG. 1A in its semi-folded position.

FIG. 1B is a partial view of the quick set-up and take-down (instant) hub (102). The instant hub (102) quickly launches the instant tent from the folded position into a fully built or expanded position. It quickly collapses the fully built or expanded instant tent into the fully folded position. The fully folded instant golf practice tent (100) may then be easily stored and transported. The instant hub (102) consists of a base cap (130) and a plurality of hub poles (132). The instant hub (102) also has a locking member (138) and a plurality of moving poles (134). A proximal end of each of the plurality of hub poles (132) is connected pivotally to the base cap (130), and the opposing distal end is connected pivotally to a distal end of the moving pole (134). Similarly, a proximal end of each of the plurality of moving poles (134) is connected pivotally to the locking member (138), and the distal end is connected pivotally to the distal end of the hub pole (132). Although each instant hub (102) comprises a plurality of hub poles (132) that are connected pivotally to a plurality of base poles (104), only a few are shown and discussed herein for brevity, clarity, and to avoid repetition.

In some embodiments, the instant hub (102) consists of a cylinder (140), and the locking member (138) comprises a bushing coaxially encircling the cylinder (140). One end of the cylinder (140) is fixedly connected to the base cap (130). The bushing enables the locking member (138) to slide along the cylinder (140) towards and away from the base cap (130). Movement of the locking member (138) towards the base cap (130) deploys the instant golf practice tent (100) into the expanded position, and movement of the locking member (138) away from the base cap (130) folds the instant golf practice tent (100). For example, a user may hold the locking member (138) and push/pull it to move the locking member (138) along the cylinder (140).

Figure 1C:
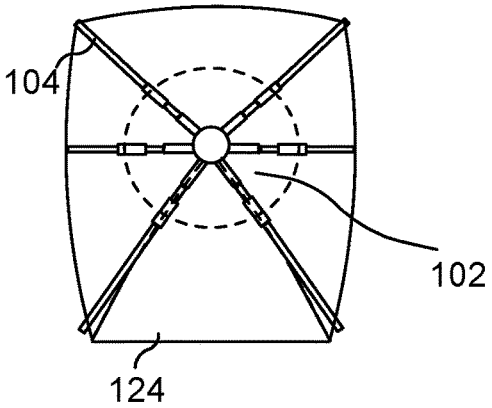
FIG. 1C is a top view of the instant tent shown in FIG. 1A.

In some embodiments, the locking member (138) is lockable at a plurality of positions along the cylinder (140) even if the instant golf practice tent (100) is not fully expanded, i.e., folded position or partially folded position. In some embodiments, the locking member (138) is lockable between and at the fully folded and fully expanded positions. In some embodiments, the locking member (138) automatically locks onto the cylinder (140) when the locking member (138) is released by the user. In some embodiments, the locking member (138) automatically locks once the instant golf practice tent (100) fully expands. In other embodiments, the locking member (138) may have a pull-to-release, twist-to-release, or press-to-release mechanism for locking/unlocking. In this disclosure, the term partially folded position is used interchangeably with partially expanded position unless stated otherwise. In some embodiments, the locking member (138) comprises a push-pull, push & press to release or push-push locked type locking mechanism (not shown) for locking the locking member (138) along the cylinder (140). Other suitable locking mechanisms may be used. FIG. 1C is a top view of the fully expanded instant golf practice tent (100) shown in FIG. 1A. The top view of FIG. 1C shows the instant hub (102) connected to the base poles (104). The roof panel (124) is fastened to the base poles (104).

FIG. 2A is a partial side view of an embodiment of instant hub (102) in its semi-folded position and is discussed herewith in relation to FIG. 1B. The instant hub (102) enables quick launching and collapsing of the instant golf practice tent (100) with minimal effort. As noted above, non-limiting examples of minimal effort include manually operating a string or ring-shaped runner for both opening and closing; or pushing a button for a spring-loaded or pneumatically operated mechanism to create a force for quickly launching and collapsing the instant tent. In addition to the above-discussed components in FIG. 1B, the instant hub (102) in FIG. 2A includes a pulley and string mechanism.

The pulley and string mechanism consists of a string (236) that is connected to or near a fixed end (210) in the locking member (138), loops around a fixed pulley (220) disposed in the base cap (130), and then loops another movable pulley (222) disposed in the locking member (138) before finally exiting from the locking member (138) and becomes accessible to the user. A hook (not shown) may be attached to the free end of the string (236) that is accessible to the user. The user may hold the locking member (138) and pull the free end of the string (236) to launch the instant golf practice tent (100). The force of quickly launching the instant golf practice tent (100) is split between the side of the string (236) connected with the fixed end (210) and the free end accessible to the user. Thus, when the user pulls on the free end, only half the force would be required in comparison to the user who opens the instant golf practice tent (100) without a pulley. The force of pulling the string (236) would move the locking member (138) for a distance (218) towards the base cap (130), thereby launching the instant golf practice tent (100) as shown in FIG. 2B. Other embodiments may have more pulleys disposed in the base cap (130) and/or locking member (138). Instead of rope and pulley, belt and gear mechanisms may be used. For folding the fully expanded instant golf practice tent (100), the user holds the locking member (138) to unlock it from the cylinder (140) and then moves it away from the base cap (130), thereby transitioning the instant golf practice tent (100) into a fully folded position. FIG. 2C shows a perspective view of the instant golf practice tent (100) in a semi-folded form.

FIG. 2D is a partial view of another embodiment of instant hub (102) with a spring mechanism consisting of a spring (224) disposed in the cylinder (140). One end of the spring (224) is connected to the base cap (130), and the opposing other end is connected to the locking member (138). Compression, extension, or another suitable type may be used as the spring (224). FIG. 2E is a side view of the instant hub (102) in FIG. 2D in its semi-folded position. To launch the instant golf practice tent (100), unlike FIG. 2A and FIG. 2B, where the user pulls the string (236), the user of the embodiment shown in FIG. 2E holds the locking member (138) and moves it along the cylinder (140) towards the base cap (130). In an embodiment, the locking member (138) is locked onto the cylinder (140) when the instant golf practice tent (100) is in the fully folded position, and the spring (224) is an extension type. In this case, as soon as the user unlocks the locking member by holding it, the spring (224) compresses to automatically exert pressure to pull the base cap (130) and locking member (138) together, thereby quickly launching the instant golf practice tent (100). To fold the instant golf practice tent (100), the user then holds the locking member, unlocks it from the cylinder (140), and pulls it away from the base cap (130), thereby applying load on the spring (224), stretching it, and folding the instant golf practice tent (100). FIG. 2F is a side view of the instant hub in FIG. 2E in its fully folded position.

Figure 3A:
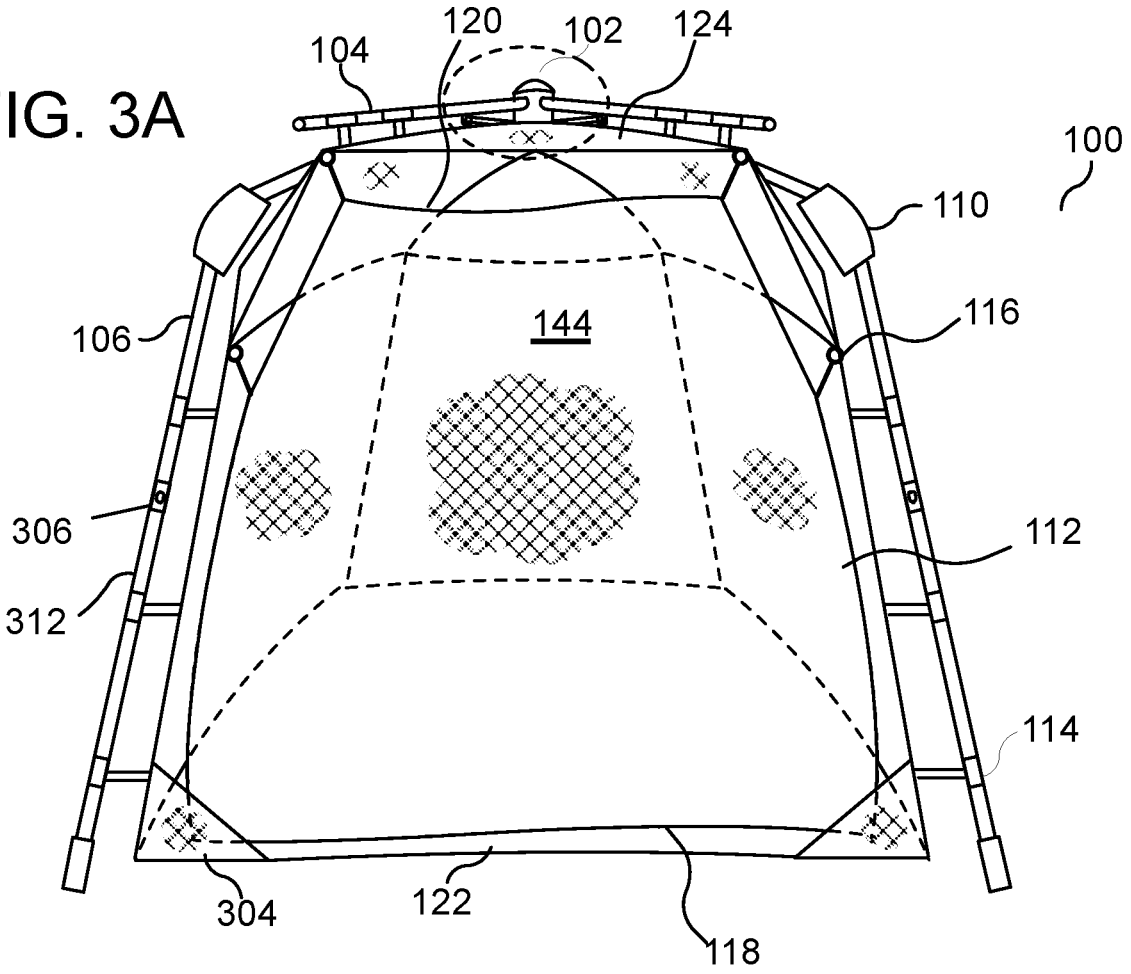
FIG. 3A is a front view of an embodiment of an instant golf practice tent.
Figure 3B:
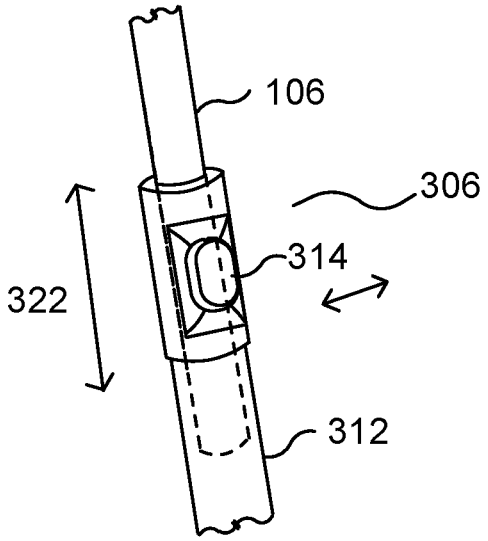
FIG. 3B is a detailed view of a joint member shown in FIG. 3A.

FIG. 3A is a front view of an embodiment of an instant golf practice tent (100). In addition to the above-discussed components in FIG. 1A, the instant golf practice tent (100) includes a joint member (306) and an extension pole (312). The joint member (306) has a push-button (314) that, when unpressed, locks/latches the telescopic pole (106) and an extension pole (312) into a position. In some embodiments, as shown in FIG. 3B, the extension pole (312) is the outer member, and the telescopic pole (106), as an inner member, is telescopically receivable in the extension pole (312). The push-button (314) is pressed to insert the telescopic pole (106) into the extension pole (312). When the desired position is reached, the push-button (314) is released/unpressed, thereby locking them into that position. The telescopic pole (106) and the extension pole (312) are movable along a direction (322). In other embodiments, the telescopic pole (106) may be an outer member, and the extension pole (312) is an inner member.

The instant golf practice tent (100) also has one or more stopping pockets (304) to prevent the golf balls hit into the instant golf practice tent (100) from flying out of the tent (100) from the front side to hurt people or damage properties. In one embodiment, the length of the forward telescopic/extension poles, which are towards the open face (154), is less than the length of the rear telescopic/extension poles, which are towards the back panel (144). This arrangement makes the floor (122) towards the back panel (144) at a higher elevation than the floor (122) near the open face (154). In other words, the floor (122) tilts forward such that the ball launched in the instant golf practice tent (100) would slide forward and gather in either of the stopping pockets (304). The stopping pockets (304) are located in the corners where the side segments of the side panel (108) contact the tent floor (122). In this embodiment, the triangular-shaped stopping pockets (304) act as barriers to stop golf balls from rolling out of the instant golf practice tent (100) via the corners of the instant golf practice tent (100). Also, the triangular-shaped stopping pockets (304) may be collapsible. Two similar stopping pockets may be also located in two top-sided corners. After practicing for a while, the user may gather the balls from the stopping pockets (304). This arrangement makes it easier for the user to collect balls, reduces cluttered balls on the field and the resulting distraction. Although, FIG. 3A shows a triangular-shaped stopping pocket (304), other shapes such as oval, rectangular, zigzag, irregular, or based on aesthetic themes (butterfly, golf ball, animals) may also be used.

Figure 4:
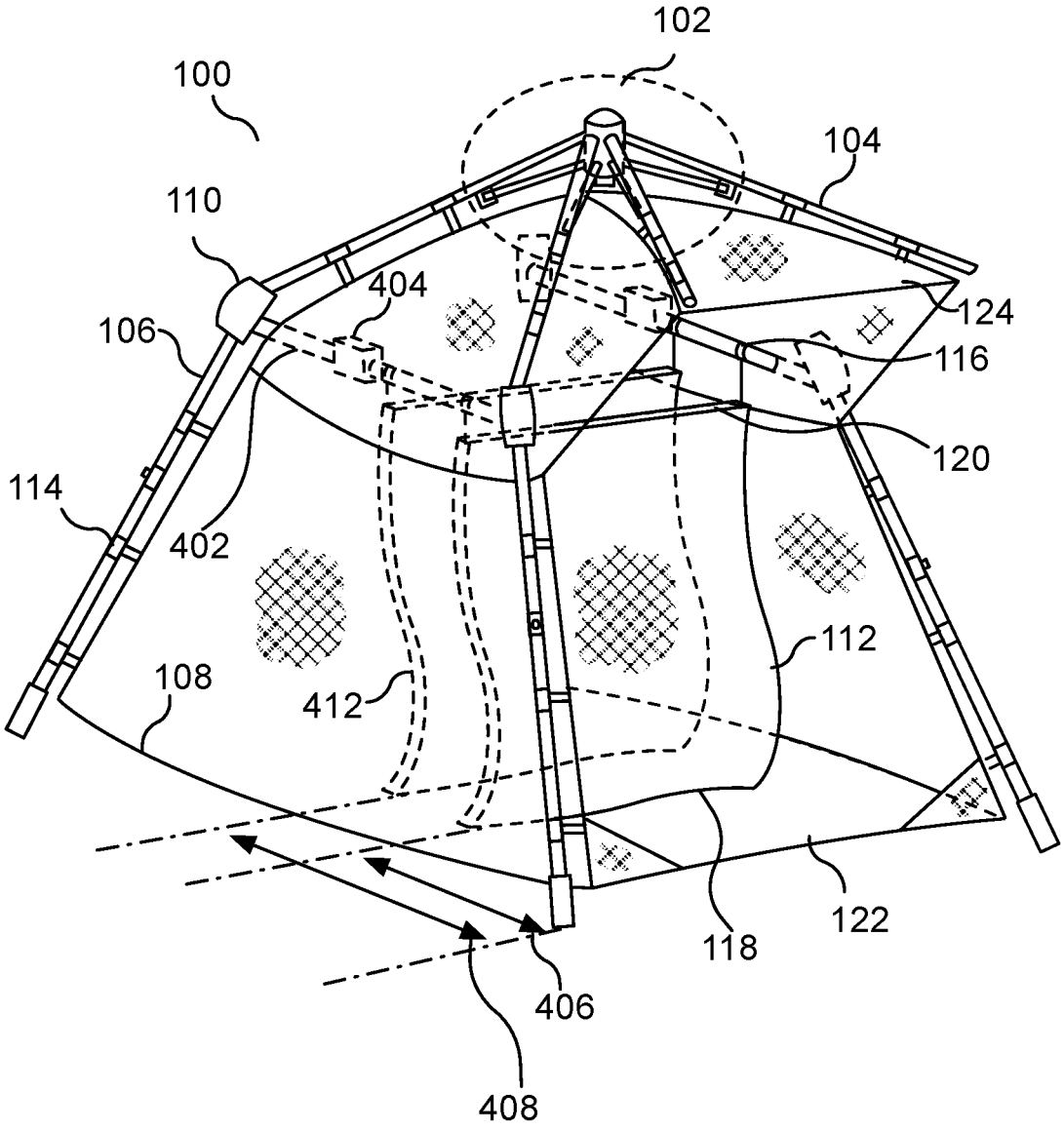
FIG. 4 is a perspective view of another embodiment of an instant tent.

FIG. 4 is a perspective view of another embodiment of instant golf practice tent (100). In addition to the above-discussed components in FIG. 1A, the instant golf practice tent (100) in FIG. 4 includes a second receiving net for accepting golf balls launched into the instant golf practice tent (100). Like the first receiving net (112), the second receiving net (412) extends vertically and is spaced apart from the back panel (144) and the open face (154). The second receiving net (412) extends vertically between the first receiving net (112) and the back panel (144). In this embodiment, the first and second receiving nets (112, 412) are fastened to a receiving pole (402) by the receiving fasteners (116). Each net/panel/curtain discussed in this disclosure is fastened toward both side panels (108) of the instant golf practice tent (100). In some embodiments, the receiving pole (402) also has a joint member (404) that may pivotally (similar to as discussed in FIG. 2A to FIG. 2F) or telescopically (similar to as discussed in FIG. 3A) joins two receiving poles (402) with each other. The instant golf practice tent (100) has two receiving poles (402) parallel to each other, generally extending from the open face (154) towards the back panel (144). In some embodiments, the receiving fasteners (116) are connected to the ceiling (124), side panels (108), and/or collapsible frame structure towards the ceiling (124).

As shown, the first (112) and second receiving nets (412) are at a first distance (406) and second distance (408), respectively, from the base of open-face (154) facing telescopic poles (106). If the golf ball is shot with such a force that the first receiving net (112) is unable to bring it to the full stop, the momentum of the golf ball is transferred to the second receiving net (412). As a result, the golf ball remains inside the instant golf practice tent (100) without rupturing any of the instant net's panels/nets. Thus, the second receiving net (412), when used in conjunction with the first receiving net (112), reduces hazards associated with practicing golf with existing collapsible practice nets, thereby preventing property damage, injuries, and lost lives.

Figure 5A:
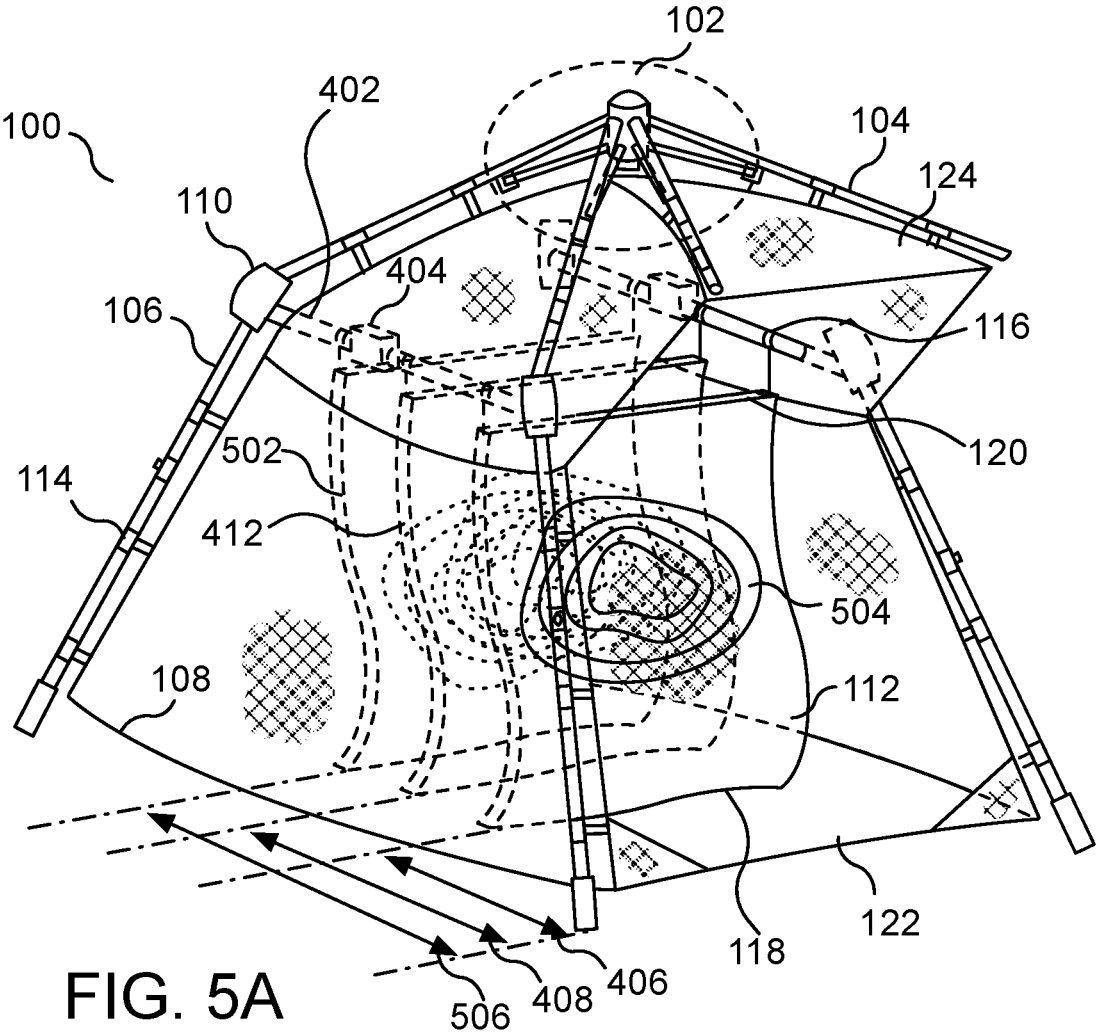
FIG. 5A is a perspective view of another embodiment of an instant tent.
Figure 5B:
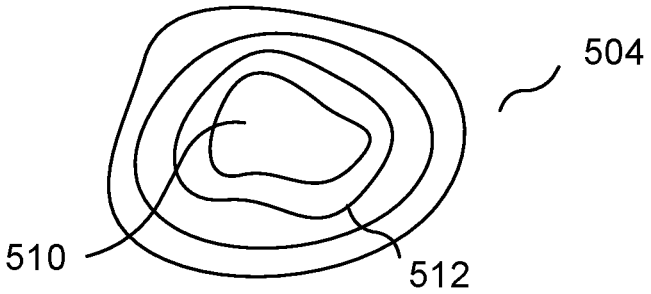
FIG. 5B is an example of a golf practicing map.

FIG. 5A is a perspective view of another embodiment of an instant golf practice tent (100). In addition to the above-discussed components in FIG. 4, the instant golf practice tent (100) in FIG. 5A includes a third receiving net (502) that extends vertically between the second receiving net (412) and the back panel (144). The third receiving net (502) is fastened to a receiving pole (402) by the receiving fasteners (116) and is at a third distance (506) from the base of open-face (154) facing telescopic poles (106). In addition, the first receiving net (112) displays a map/mark (504) on it. The user uses this map (504) as a simulated indicator and target to shoot a golf ball into the instant golf practice tent (100). A variety of, but not limited to, maps, pictures, or diagrams may be used for practice. Different maps indicate and simulate different holes, directions, and distances from the hole, terrain, golf courts, and even weather. FIG. 5B illustrates one design example of said map or mark (504). The map (504) looks like a topographic map with contour lines. Each line on a map represents an imaginary line on an actual golf court, all points of which are at the same swing distance from the hole. The center region (510) may represent a part of a green and the next region (512) may represent a sand. A hitting location of a golf ball on the map (504) can be used together with maps/marks (406, 408, 506) on the floor panel (122) to indicate the golf ball's real trajectory in an actual golf court. The hitting location of a golf ball on the map (504) mostly contains swing directional information; and the mark on the floor (122) mostly contains striking force information. The detail will be described in the following paragraphs. The other receiving nets (412, 502) may also be printed a corresponding map/mark.

Figure 6A:
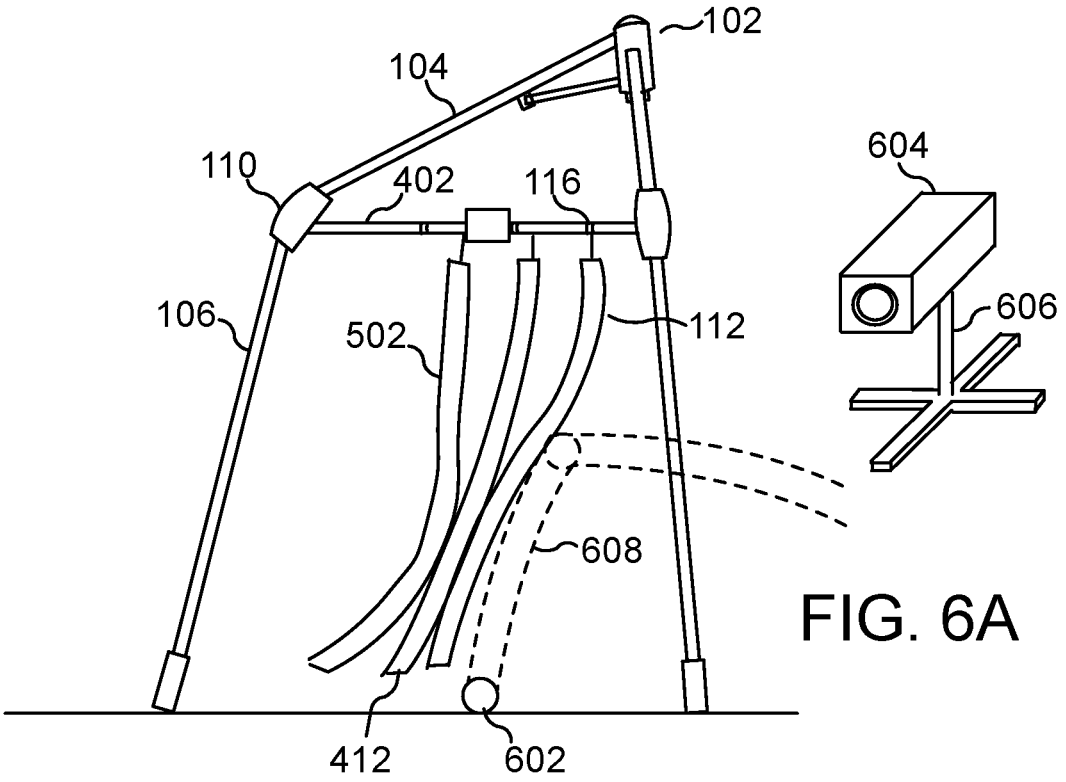
FIG. 6A is a partial side view of the embodiment in FIG. 5A with a trajectory monitoring device.

FIG. 6A is a partial side view of the embodiment (100) shown in FIG. 5A with a tracking device 604. A stand (606) is used to position the tracking device 604. In some embodiments, the stand (606) is operable to deploy the tracking device 604 at different heights and/or tracking angles. In other embodiments, the stand (606) is adjustable to change the height and/or tracking angle of the tracking device 604. The user shoots the ball (602) into the instant golf practice tent (100). The ball (602) hits the first receiving net (112) and follows the trajectory 608, as shown, before falling. The second and third receiving net (412, 502) if available will also be affected and pushed by the first receiving net (112) and the ball (602). In some embodiments, the tracking device 604 consists of one or more cameras and/or other sensors (not shown) deployed at one or more locations. Output from these cameras/sensors is processed using the instant or offline prediction software to translate the trajectory 608 into a simulated trajectory (not shown) of the ball (602) as if it was shot on the actual golf court. The simulation result may be depicted on the first receiving net (112) and/or on the other receiving nets (412, 502). The simulated trajectory calculates an error (if any) between the desired distance and the actual distance. This is discussed below in detail in reference to FIG. 7A to FIG. 7C.

Figure 6B:
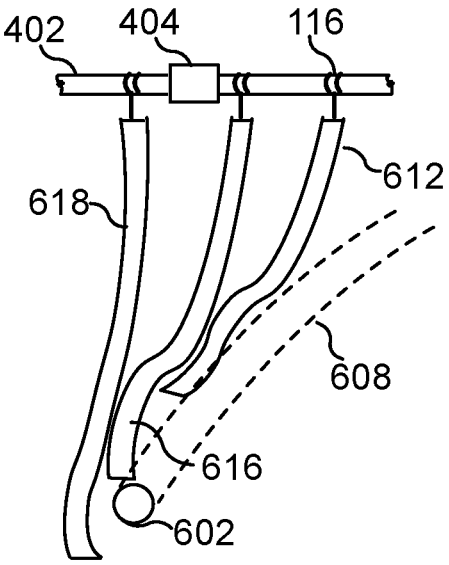
FIG. 6B and FIG. 6C are partial side views of two alternate embodiments of the golf receiving nets shown in FIG. 6A.

FIG. 6B is a partial side view of an alternate embodiment of the golf receiving nets shown in FIG. 6A. In this embodiment, a first panel (612) extends vertically and is fastened to the receiving pole (402). Similarly, a second panel (616) extends between the first panel (612) and the back panel (144), and a third panel (618) extends between the second panel (616) and the back panel (144). This sandwiches the second panel (616) between the first panel (612) and the third panel (618). These panels have different vertical lengths, with the first panel (612) being the shortest and the third panel (618) longest among the three panels. Thus, the length of the second panel (616) is somewhere in-between the length of the first panel (612) and the third panel (618). As shown, the ball (602) hits the first panel (612), the second panel (616), and follows the trajectory 608 before falling. As discussed above, the tracking device 604 may be used with an alternate embodiment. In some embodiments, the number of nets/panels/curtains used in the instant net may be more than discussed in this disclosure. For example, the number of nets/panels/curtains is 4, 5, or 6.

Figure 6C:
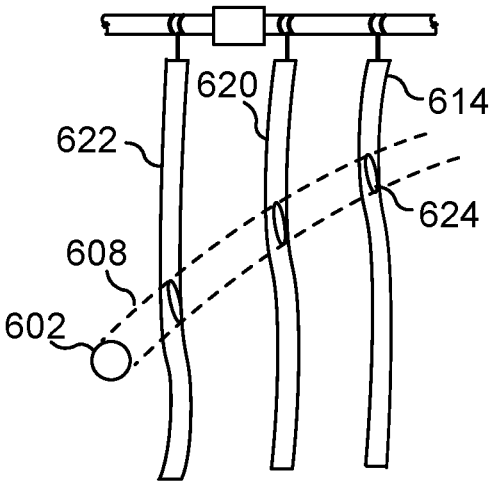

FIG. 6*c* is another partial side view of an alternate embodiment of the golf receiving net shown in FIG. 6*a*. In this embodiment, a first curtain (614) extends vertically and is fastened to the receiving pole (402). Similarly, a second curtain (620) extends between the first curtain (614) and the back panel (144), and a third curtain (622) extends between the second curtain (620) and the back panel (144). This sandwiches the second curtain (620) between the first curtain (614) and the third curtain (622). These curtains may have similar vertical lengths. As shown, the ball (602) hits the first curtain (614), the second curtain (620), and follows the trajectory 608 before falling. Unlike FIG. 6B, the curtains in FIG. 6C are similar to shooting targets used in firearm training. Like shooting targets, the ball (602) leaves an impression (i.e., hole 624) on each curtain (614, 620, 622) when the ball (602) is shot into the instant golf practice tent (100). The position of the holes (624) in each curtain shows actual trajectory 608 of the ball (602), and in turn, is used to ascertain a simulated trajectory of the ball (602) as if it was shot on the actual golf court. As discussed above, the tracking device 604 may be used with this alternate embodiment. The holed curtains may be used for evaluative or record purposes. As discussed above, the tracking device 604 may be used with an alternate embodiment. In yet another alternative embodiment, the first, second, and third curtains or nets (614, 620, 622) are weaved nets with the same or different sized weaving holes that relate to the golf ball size. The size of the weaving hole is small enough to give the golf ball (602) attenuation in speed but still big enough for the golf ball (602) to pass through. The trajectory tracking and simulation can also be done in a similar way as discussed above.

Figure 7A:
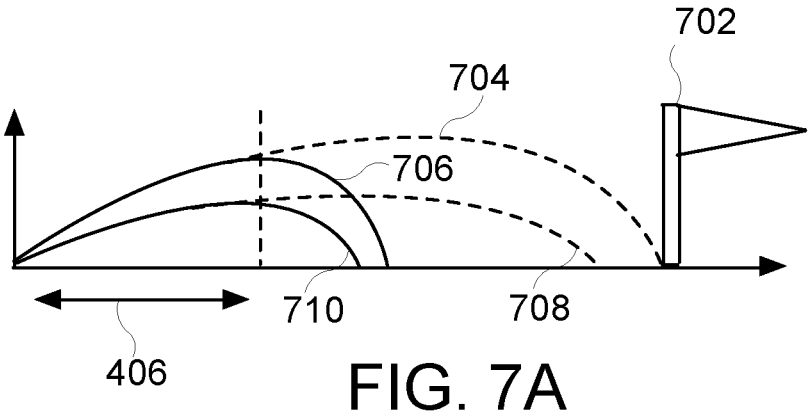
FIG. 7A is a graphical representation of an example of a trajectory path.
Figure 7B:
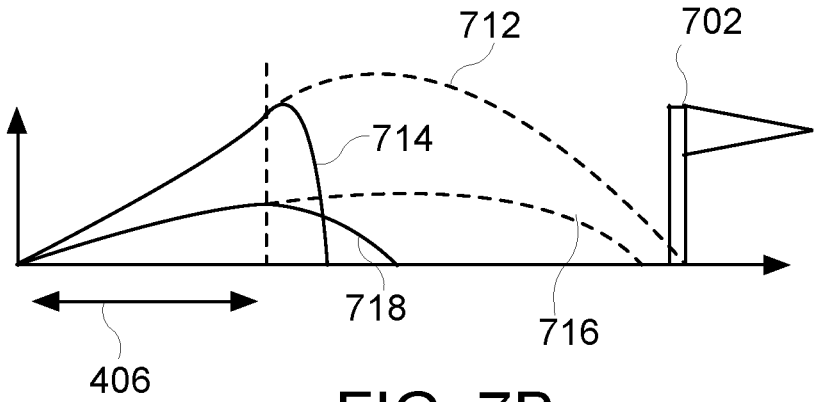
FIG. 7B is a graphical representation of another example of a trajectory path.
Figure 7C:
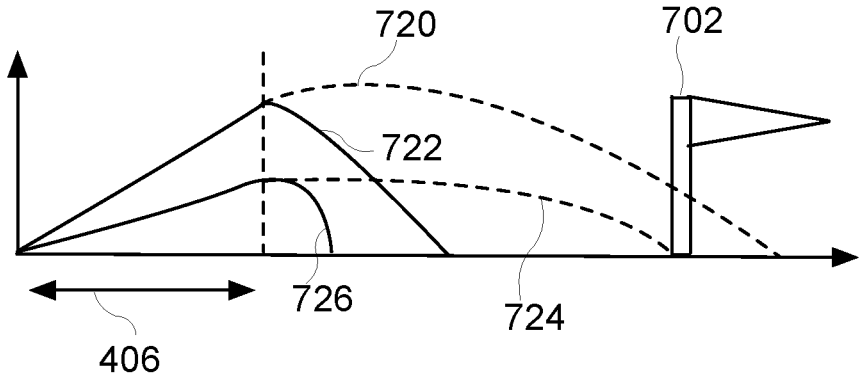
FIG. 7C is a graphical representation of yet another example of a trajectory path.

FIG. 7A to FIG. 7C are a graphical representation of three examples of trajectory paths. These trajectory paths are discussed below in detail. (702) represents a flagstick or hole in an actual golf court, where the user wants to sink the ball. In the actual golf court, the ball needs to follow trajectory (704, 712, 724) for successfully sinking into the hole (702). Alternatively, if the ball (602) is hit with the same force into the instant golf practice tent (100) for the ball to sink into the hole, the ball (602) would follow the trajectory (706, 714, and 726), respectively. Distance (406) represents the actual distance from the starting point of the golf ball (602) up to the first net/panel/curtain targeted by the user. As shown, the ball's speed gets attenuated, and the trajectory gets changed once it hits the first net/panel/curtain. Thus, if a trajectory of (706, 714, 726) is indicated by reading from the map (504) and marks for distances (406, 408, 506) on the floor panel (122) or observed by the tracking device (604), the user or prediction software would conclude that the ball should sink into the hole (702).

However, if the user hits the ball (602) with such a force to follow trajectory (708, 716, 720), it means that the ball (602) would follow trajectory (710, 718, 722), respectively, once it hits the first net/panel/curtain. The tracking device (604) would observe trajectories (710, 718, and 722) to calculate the difference between the actual distance/trajectory and the intended distance/trajectory. Instead of the tracking device (604), one may use the distance from the starting point of the ball (602) up to the point where the ball (602) stops on the ground/instant tent's floor (122) to ascertain the actual error if the ball (602) was shot in the golf court. In some embodiments, as shown in FIG. 5A, the markings of the first, second, and third distances (406, 408, 506) on the floor may be representative of the actual distance/error of the ball if shot at an actual golf court.

Figure 8:
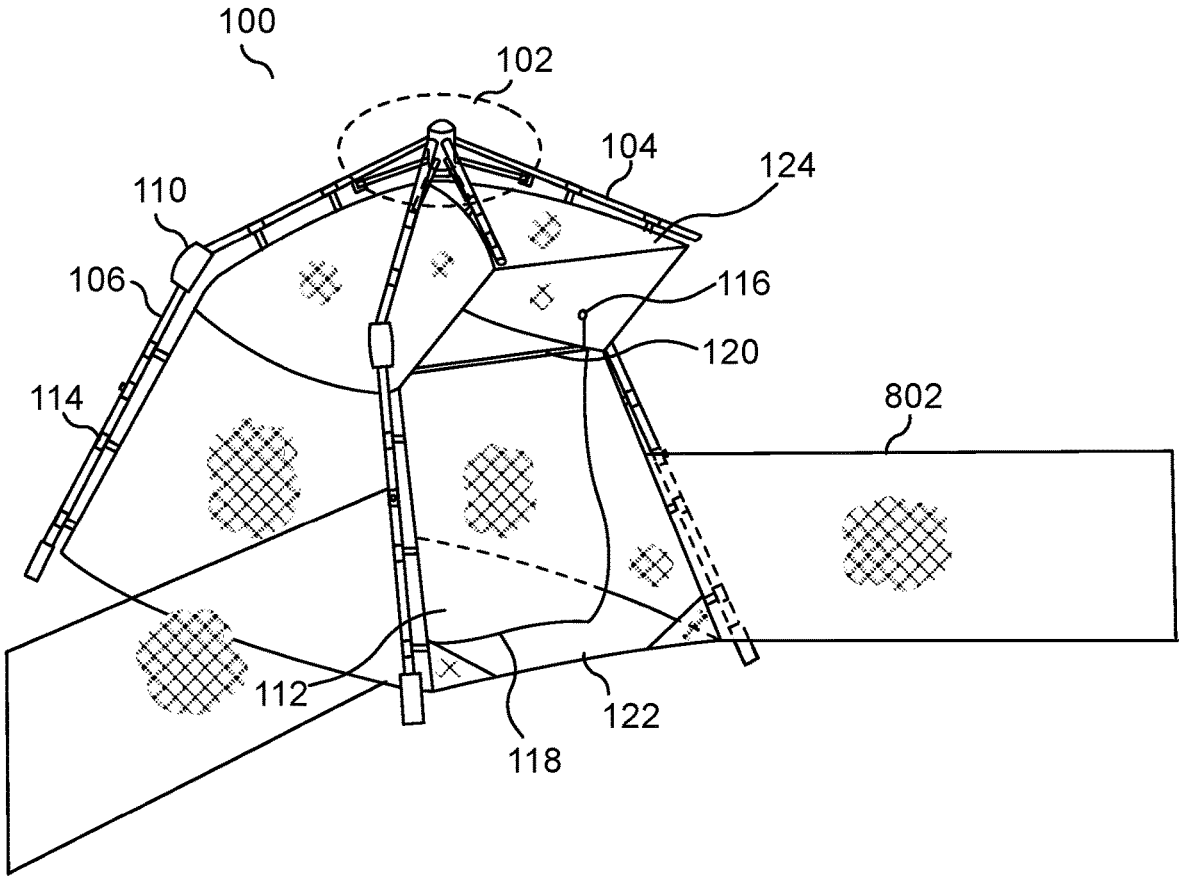
FIG. 8 is a perspective view of another embodiment of an instant tent.

FIG. 8 is a perspective view of another embodiment of an instant golf practice tent (100). This embodiment includes a rectangular-shaped extension panel (802) extending laterally outwards from the instant golf practice tent (100) and contacts the ground. Each rectangular shaped extension panel (802) (one on the right side and/or one on the left side of the instant golf practice tent 100) would be attached to the instant golf practice tent (100) and extends laterally outwards from the instant golf practice tent (100), thereby producing a planar face that faces the user. In this embodiment, the rectangular-shaped extension panel (802) acts as a barrier to stop golf balls (602) hit towards the instant golf practice tent (100), but that misses the instant golf practice tent (100) altogether. In addition, these extension panels (802) facilitate stopping retrieving balls (602) that have been mis-hit or misdirected when hit towards the instant golf practice tent (100). Although this embodiment describes rectangular-shaped extension panels (802), the disclosed embodiments support other shapes for the extension panels (802), such as triangular, circular, or irregular. Also, said rectangular-shaped extension panels (802) might be collapsible.

Figure 9A:
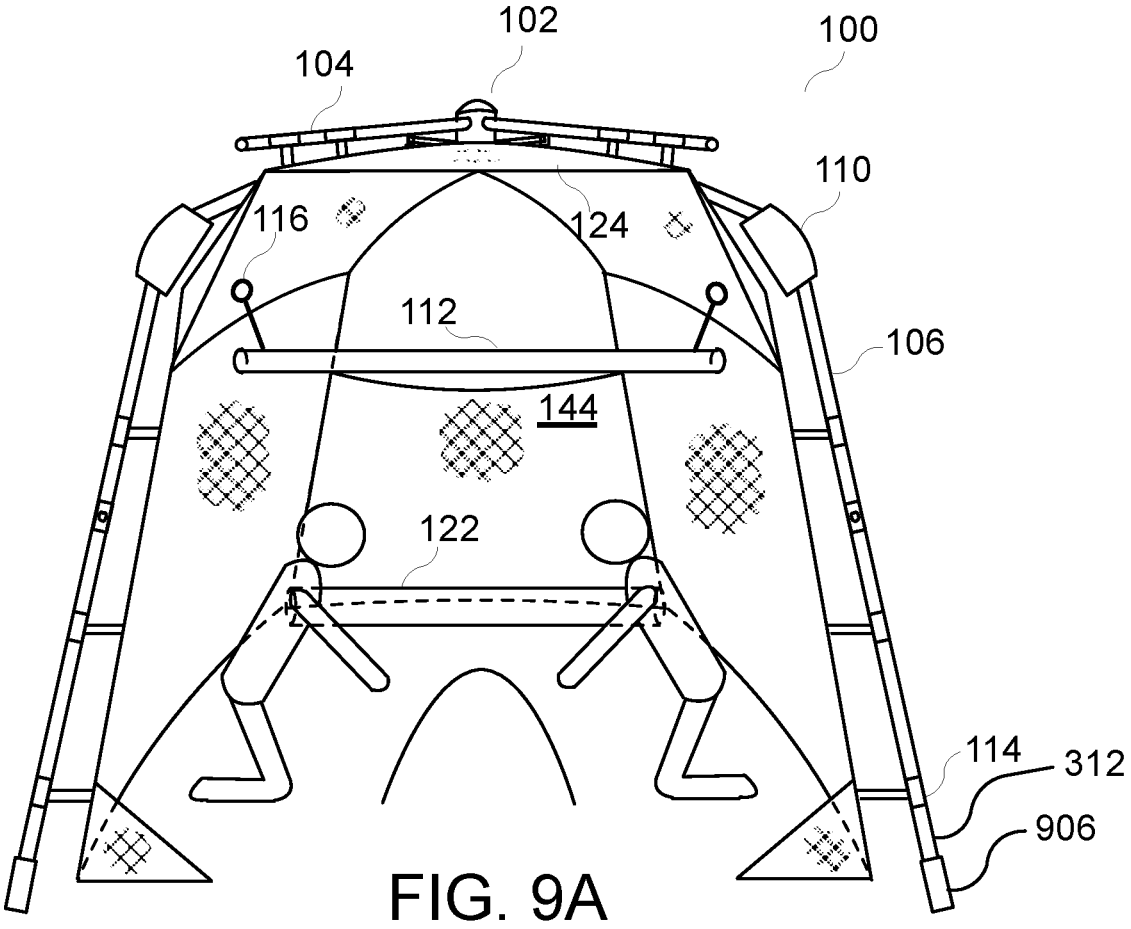
FIG. 9A is a front view of another embodiment of an instant golf practice tent.

FIG. 9A is a front view of another embodiment of an instant golf practice tent (100). In this embodiment, the tent floor (122) may be retracted or coupled (via stitching or the use of a zipper) solely to the back panel (144) of the instant golf practice tent (100). This allows for the floor (122) to be rolled up into a cylindrical form, allowing users to access the ground, which may be desirable in certain situations, such as at a park or the beach. The first receiving net (112) is rolled up to create an obstacle-free area within the instant golf practice tent (100) for the user's activity. Like the first receiving net (112), other nets/panels/curtains are also rolled up. FIG. 9A shows a means for extending the length of a frame member, i.e., extension feet (906).

Figure 9B:
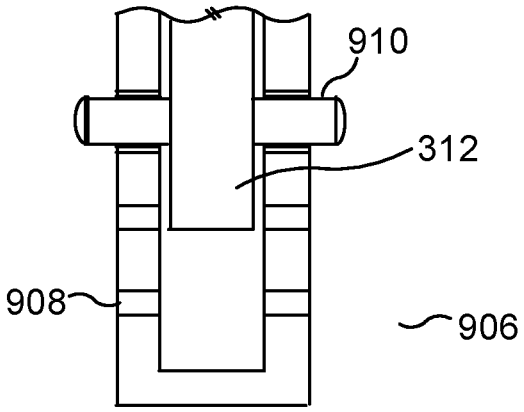
FIG. 9B is a detailed view of an extension member shown in FIG. 9A.

FIG. 9B is a cross-sectional view of the extension feet (906) shown in FIG. 9A. The extension feet (906) can be a tubular-shaped body adapted to receive the lower end of an extension pole (312). Along the tubular-shaped body of the extension feet (906) are a pair of opposing holes or openings (908). Each of the opposing holes is adapted to receive a movable pin (910) on the lower end of the extension pole (312). Each of the pins (910) can be adapted to move inward when inward forces are applied to it and are adapted to return to their original position when such forces are removed. In operation, the forces applied to the pin (910) can move the pins (910) inward so that the pin (910) can clear the body of the extension feet (906), allowing the rigid extension pole (312) to move between the sets of holes (908) on the body of the extension feet (906).

After the extension pole (312) is at the preferred position, and the pins (910) align with a set of holes (908), the inward forces can be removed from the pin (910), allowing the pins (910) to return to their original position and locking the extension pole (312) into position inside the extension feet (906). The extension feet (906) allow the user to adjust the length of the extension poles (312) and/or the tent opening/facing direction depending on the user's preference. The length of the extension feet (906) may be adjusted such that the tent floor (122) is tilting forward, backward, or sideways when viewed in a direction from the open face (154) toward the back panel (144). However other embodiments, are within the scope and spirit of the invention. In one embodiment, the extension feet (906) may be composed of a flexible material, such as plastic, polymers, metal, alloys, ceramic, carbon fibers, or other materials with characteristics that allow flexibility of the extension feet (906). In another embodiment, the extension feet (906) may be adjusted automatically by an electrical or mechanic mechanism such as step motors with sensors upon a golf ball hitting on a certain portion of a receiving net (112), so the instant tent (100) can collect the ball in a more desirable direction and/or position.

In yet another embodiment of the present disclosure, the back panel (144) can be lowered or retracted, or rolled down to have a bigger or full opening at the back. Similar features can be implemented to the other panels.

The method for the instant tent includes providing the components discussed above in an above-discussed manner to provide a golf practice instant tent that provides ease of unfolding/folding is equipped with providing above-noted features and reduces the likelihood and severity of injury to the golf enthusiast and of damage to the golf practice instant tent in a cost-effective manner.

The terms and expressions which have been employed herein as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents. Various features, aspects, and embodiments have been described herein. The features, aspects, and embodiments are susceptible to combination with one another as well as to variation and modification, as will be understood by those having skill in the art. The present disclosure should, therefore, be considered to encompass such combinations, variations, and modifications.

The invention claimed is:

1. An instant multifunctional golf practicing tent, comprising:

a ceiling, a floor, two opposing side panels, a back panel, and an open face configured to accept golf balls;

a collapsible frame including at least six poles positioned at least partially external to the ceiling, the two opposing side panels, and the back panel, the at least six poles including at least four base poles and at least two canopy poles, wherein the at least two canopy poles extend from the ceiling at the open face without connection to the floor, the canopy poles configured to support the ceiling at the open face to maintain a higher opening and predetermined width of the open face for consistent golf ball entry;

a receiving net having an upper end coupled to the ceiling, the two opposing side panels, or the collapsible frame, and a lower end extending loosely toward the floor, spaced apart from the back panel and the open face, the receiving net configured to capture golf balls; and an instant hub operatively connected to the collapsible frame, the instant hub positioned external to an interior enclosed space defined by the ceiling, side panels, and back panel, the instant hub including a pulley, a cable, and a spring, wherein the cable is operated through the pulley and the spring assists in biasing the at least six poles into an expanded position upon pulling the cable, and in collapsing the at least six poles back to a folded position upon releasing the cable, wherein the pulley, cable, and spring cooperate to reduce the deployment force compared to manual deployment without a pulley, enabling rapid deployment and collapse with minimal user effort.

2. The instant multifunctional golf practicing tent of claim 1, further comprising a second receiving net disposed between the receiving net and the back panel, the second receiving net having an upper end coupled to the ceiling or the collapsible frame, and a lower end extending loosely toward the floor, spaced apart from the back panel and the receiving net, the second receiving net configured to capture golf balls that reach the second receiving net after being slowed or redirected by the receiving net for being used to analyze impact and performance through progressive capture of golf balls.

3. The instant multifunctional golf practicing tent of claim 2, further comprising a third receiving net disposed between the second receiving net and the back panel, the third receiving net having an upper end coupled to the ceiling or the collapsible frame, and a lower end extending loosely toward the floor, spaced apart from the back panel and the second receiving net, the third receiving net configured to capture golf balls that reach the third receiving net after being slowed or redirected by the receiving net and second receiving net for being used to analyze impact and performance through progressive capture of golf balls.

4. The instant multifunctional golf practicing tent of claim 3, wherein the receiving net, the second receiving net, the third receiving net, and a floor panel disposed on the floor each includes marks indicating ball hitting positions, the marks configured to provide measurement of practicing performance including swing accuracy and distance.

5. The instant multifunctional golf practicing tent of claim 3, wherein the receiving net, the second receiving net, and the third receiving net each include marks configured to evaluate swing accuracy.

6. The instant multifunctional golf practicing tent of claim 2, wherein the receiving net, the second receiving net, and a floor panel disposed on the floor each includes marks indicating ball hitting positions, the marks configured to provide measurement of practicing performance including swing accuracy and distance.

7. The instant multifunctional golf practicing tent of claim 2, wherein the second receiving net includes at least one weaving hole having a size comparable to a golf ball, configured to allow a golf ball to pass through the second receiving net.

8. The instant multifunctional golf practicing tent of claim 7, wherein the at least one weaving hole in the receiving net and the at least one weaving hole in the second receiving net have different sizes to provide varying levels of difficulty for a golf ball to pass through.

9. The instant multifunctional golf practicing tent of claim 1, further comprising at least two receiving poles, one on each of the left and right sides of the tent, each receiving pole extending from the front to the back between two base poles of the collapsible frame to provide added lateral strength to the frame, the receiving poles configured to support the receiving net fastened thereto.

10. The instant multifunctional golf practicing tent of claim 1, wherein the receiving net includes marks configured to evaluate swing accuracy by indicating a golf ball's impact position.

11. The instant multifunctional golf practicing tent of claim 1, further comprising a floor panel disposed on the floor, the floor panel including marks configured to evaluate practicing performance, the marks indicating at least one of swing accuracy or distance.

12. The instant multifunctional golf practicing tent of claim 1, wherein the receiving net includes at least one weaving hole having a size configured to allow a golf ball to pass through with attenuation in speed for evaluating swing accuracy and distance.

13. The instant multifunctional golf practicing tent of claim 1, wherein a corner of the instant multifunctional golf practicing tent includes a stopping pocket at the floor, the stopping pockets configured to capture golf balls to prevent them from flying out of the instant multifunctional golf practicing tent.

14. The instant multifunctional golf practicing tent of claim 1, further comprising extension panels coupled to the two opposing side panels at the open face, the extension panels configured to extend outward to widen the open face for capturing errant golf balls.

15. The instant multifunctional golf practicing tent of claim 1, wherein the floor is removable or retractable to enable a camping function by exposing the ground beneath the tent.

* * * * *